US006149862A

United States Patent [19]

Gliklad et al.

[11] Patent Number: 6,149,862

[45] Date of Patent: Nov. 21, 2000

[54] IRON-SILICON ALLOY AND ALLOY PRODUCT, EXHIBITING IMPROVED RESISTANCE TO HYDROGEN EMBRITTLEMENT AND METHOD OF MAKING THE SAME

[75] Inventors: Naum I. Gliklad, Flushing; Avgust B. Kuslitskiy, Brooklyn, both of N.Y.; Leonid A. Kuslitskiy, Houston, Tex.

[73] Assignee: The Atri Group Ltd., New York, N.Y.

[21] Appl. No.: 09/313,819

[22] Filed: May 18, 1999

[51] Int. Cl.[7] ..... C22C 38/02; C22C 38/46

[52] U.S. Cl. ..... 420/83; 420/112; 420/8; 420/104; 420/89; 420/123; 420/125; 420/127; 420/128; 420/129; 420/82; 420/84; 420/122; 420/126

[58] Field of Search ..... 420/117, 8, 104, 420/127, 83, 89, 112, 40, 123, 128, 125, 129, 122, 126, 82, 84

[56] References Cited

U.S. PATENT DOCUMENTS

| | | | |
|---|---|---|---|
| 3,698,964 | 10/1972 | Caule et al. | 148/31.5 |
| 3,853,544 | 12/1974 | Nishi et al. | 75/125 |
| 3,895,939 | 7/1975 | Brooks et al. | 75/124 |
| 3,909,250 | 9/1975 | Jasper | 75/124 |

(List continued on next page.)

FOREIGN PATENT DOCUMENTS

| | | | |
|---|---|---|---|
| 0202793 | 11/1986 | European Pat. Off. . | |
| 0368487 | 5/1990 | European Pat. Off. . | |
| 0585078A1 | 3/1994 | European Pat. Off. . | |
| 2146308 | 4/1972 | Germany | 420/117 |
| 45-4172 | 2/1970 | Japan | 420/117 |
| 2131832A | 6/1984 | United Kingdom . | |
| WO9324269 | 12/1993 | WIPO . | |

OTHER PUBLICATIONS

Japanese Abstract, JP 05295481A, Nov. 9, 1993.
Japanese Abstract, JP 06271975A, Sep. 27, 1994.

*Primary Examiner*—Deborah Yee
*Attorney, Agent, or Firm*—Fulbright & Jaworski L.L.P.

[57] ABSTRACT

An alloy and alloy product has about 1.3% to 1.7% by weight concentration of silicon, along with iron, alloying elements, and inevitable impurities and exhibits improved resistance to hydrogen embrittlement and sulfide stress cracking in an intensive hydrogen-charged medium wherein H from the medium acts as an alloying element. The alloy is characterized by an Fe—Si—H system wherein Fe is a donor element with respect to Si and Si is an acceptor element with respect to Fe. Further, the alloying elements are Fe—Si noninteractive elements with respect to Fe and Si, such that the presence of the alloying elements are not donor or acceptor elements with respect to Fe or Si. In several alloy compositions, the alloy has between about 1.38% to 1.63% weight Si. The alloy may further include between about 0.10% to 0.25% weight of C. In one particular alloy, the alloy composition includes about 0.18% of C; although, in one alloy product, an alloy is used having about 0.16% to 0.24% weight of C. Further, in one or more alloy products, an alloy may have up to about 0.10% weight of at least one alloying element selected from the group consisting of Be, Mg, Al, Ca, Sc, Ti, V, Cr, Mm, Co, Ni, Cu, Zn, W, Mo, Ge, Se, Rb, Zr, Nb, Ru, Ag, Cd, La, Ce, Pr, Nd, Gd, Tb, Dy, Er, Re, Os, Pb, Bi, U, N and other REM.

38 Claims, 2 Drawing Sheets

U.S. PATENT DOCUMENTS

| | | | |
|---|---|---|---|
| 3,915,697 | 10/1975 | Giuliani et al. | 75/124 |
| 3,969,151 | 7/1976 | Hill et al. | 148/6.3 |
| 4,076,525 | 2/1978 | Little et al. | 75/128 B |
| 4,153,454 | 5/1979 | Emi et al. | 75/124 |
| 4,168,188 | 9/1979 | Asphahani | 148/32 |
| 4,245,698 | 1/1981 | Berkowitz et al. | 166/244 |
| 4,302,247 | 11/1981 | Abe et al. | 75/122 |
| 4,305,755 | 12/1981 | Wilde | 75/124 |
| 4,325,748 | 4/1982 | Nashiwa et al. | 148/2 |
| 4,400,225 | 8/1983 | Ishikawa et al. | 148/36 |
| 4,464,209 | 8/1984 | Taira et al. | 148/36 |
| 4,515,914 | 5/1985 | Tsurumi et al. | 523/201 |
| 4,519,537 | 5/1985 | Heinrich et al. | 228/221 |
| 4,591,393 | 5/1986 | Kane et al. | 148/11.5 |
| 4,631,095 | 12/1986 | von Hagen et al. | 148/12 F |
| 4,721,536 | 1/1988 | Grob et al. | 148/12 F |
| 4,778,651 | 10/1988 | Dubuisson et al. | 420/57 |
| 4,836,869 | 6/1989 | Olson et al. | 148/331 |
| 4,919,885 | 4/1990 | Meyer et al. | 420/104 |
| 4,942,922 | 7/1990 | Redmerski et al. | 165/134.1 |
| 5,017,246 | 5/1991 | Miyasaka et al. | 148/135 |
| 5,108,518 | 4/1992 | Fukui et al. | 148/12 R |
| 5,117,874 | 6/1992 | Ochiai et al. | 138/140 |
| 5,147,602 | 9/1992 | Andresen et al. | 420/35 |
| 5,221,374 | 6/1993 | Blondeau et al. | 148/335 |
| 5,232,520 | 8/1993 | Oka et al. | 148/542 |
| 5,320,687 | 6/1994 | Kipphut et al. | 148/325 |
| 5,523,540 | 6/1996 | Coldren et al. | 219/137 WM |
| 5,695,576 | 12/1997 | Beguinot | 148/328 |
| 5,702,539 | 12/1997 | Schoen et al. | 148/111 |

IRON-SILICON ALLOY AND ALLOY PRODUCT, EXHIBITING IMPROVED RESISTANCE TO HYDROGEN EMBRITTLEMENT AND METHOD OF MAKING THE SAME

BACKGROUND OF THE INVENTION

The present invention relates generally to an alloy and, alternatively, to an alloy product, both of which exhibits an improved resistance to hydrogen embrittlement and sulfide stress cracking.

Exposure of steel to hydrogen-charging media can give rise to cracking. The present invention is particularly adapted to applications wherein the alloy product is employed in a hydrogen-charging medium containing $H_2S$ or gaseous Hydrogen. Such a hydrogen-charging medium is commonly encountered in well drilling applications and in the transportation, production, and storage of petroleum and natural gas, as well as in the chemical industry.

SUMMARY OF THE INVENTION

It is one of several objects of the invention to provide an alloy and an alloy product which exhibit improved resistance to hydrogen embrittlement and to sulfide stress cracking. More particularly, it is a general object of the invention to provide an iron-silicon alloy or an iron-silicon alloy product having such characteristics and a method of making the same.

The alloy according to the invention preferably has about 1.3% to 1.7% by weight concentration of silicon, along with iron and inevitable impurities. More preferably, the alloy has between about 1.4 to 1.6% weight of silicon and alloying elements.

In the Fe—Si—H system of the invention, the iron acts as an electron donor while the silicon acts as an electron acceptor. Silicon within the preferred concentration range effects an electron restructuring that produces a quasi-stable Fe—Si—H system in an intensive hydrogen-charging medium. During this restructuring, iron gives off an electron to restructure its outermost electron configuration to a more stable structure or configuration (quasi-stable "half-filled") while silicon adds electrons to build its outermost electron configuration into a more stable configuration (quasi-stable "filled"). The Fe—Si—H system, according to the invention, may be referred to as a quasi-stable system preferably having silicon concentrations of from about 1.3% to about 1.7% weight and, more preferably, from about 1.4% to about 1.6% weight.

Introducing additional alloying elements into the Fe—Si—H system produces an alloy according to the invention having certain desirable physical properties (e.g., high strength, hardness, etc.). In this regard, it is noted that the quasi-stability of the system depends on the stability of the created electron configuration and that the introduction of other elements (atoms) into the quasi-stable system may change a donor-acceptor interaction of the Fe—Si—H system, thereby affecting its quasi-stability. Accordingly, in one aspect of the invention, additional alloying elements are selected on the basis that such introduction of alloying elements does not affect the donor-acceptor interaction of the system and, thus, will not negatively affect the resulting alloy's resistance to hydrogen embrittlement and sulfide cracking resistance. For purposes of description only and with respect to the inventive Fe—Si—H system, these elements are referred to herein as "Fe—Si noninteractive" elements (and are deemed acceptable alloying elements).

Moreover, according to the invention, one or more additional alloying elements may be included in the alloy system of the invention (i.e., to attain certain desirable mechanical properties in the alloy) if it does not interfere with the desired Fe—Si interaction. More specifically, an alloying element may be included if it does not prevent the creation of the half-filled and filled quasi-stable configurations of Fe and Si in an intensive hydrogen-charging medium, as described briefly above.

A method of selecting alloying elements according to the invention involves a two-stage process. First, an element is selected that can provide required qualitative and quantitative properties in the alloy. Second, the selected alloying element is tested according to a criteria of consistency with the characteristics of donor-acceptor interaction. If the addition of the alloying element does not interfere with the desirable Fe—Si donor-acceptor interaction and does not alter the quasi-stability of the Fe—Si—H system, it is deemed an acceptable alloying element. If the element interferes with the donor-acceptor interaction and quasi-stability of the Fe—Si—H system, it is rejected as an alloying element.

In any event, it has been found that the majority of potential alloying elements will not interfere with the desired Fe—Si interaction (and thus, may be included as an alloying element) if included in the alloy in an amount of less than or equal to 0.10% weight. Alloying elements falling under this category include, but are not necessarily limited to the following elements: Be, Mg, Al, Ca, Sc, Ti, V, Cr, Mn, Co, Ni, Cu, Zn, W, Mo and some REM. Other such alloying elements include Ge, Se, Rb, Zr, Nb, Ru, Ag, Cd, La, Ce, Pr, Nd, Gd, Tb, Dy, Er, W, Re, Os, Pb, Bi, U, N and other REM.

In alternative embodiments, the alloy further includes between 0.10% to 0.26% weight Carbon. In one particular embodiment, the inventive alloy includes about 0.18% Carbon, while in further alternative embodiments, the inventive alloy includes between about 0.15% to 0.23% weight Carbon.

BRIEF DESCRIPTION OF THE PREFERRED EMBODIMENTS

FIG. 1 is a graph of the hydrogen occlusion ability of iron-silicon alloys, according to the invention, at various concentrations of silicon content; and FIG. 2 is a graph showing certain properties of hydrogen charged low carbon steels at various concentrations of silicon content.

DETAILED DESCRIPTION OF THE PREFERRED EMBODIMENT

In one aspect of the present invention, an iron-silicon alloy is provided that exhibits improved resistance to hydrogen embrittlement and sulfide stress cracking. The inventive alloy is, therefore, adapted as a structural steel material for use in environments where water and hydrogen sulfide are present. A structural steel material according to the invention is particularly useful in the oil and natural gas industry, for example, for the fabrication of oil or gas well tubing and casing, drill rig rods, line pipes, and plates for steel storage tanks, as well as in the chemical industry.

In another aspect of the invention, a unique synthesis for alloy compositions is provided which may be employed to formulate a variety alloy having certain desirable physical properties (i.e., mechanical and other properties), in addition to improved resistance to hydrogen embrittlement and sulfide stress cracking. Therefore, it is to be understood that the invention is not to be limited to the particular alloys described herein for exemplary purposes. It will be apparent to one skilled in the art, upon reading the Description (particularly after reading the description of determining advantageous alloy compositions) and viewing the Drawings, to formulate other desirable alloys and to produce alloy products for various applications, including structural materials for oil and natural gas facilities.

Applicants have derived, through extensive studies and experimentation, a two-stage process or analysis for determining or predicting potentially advantageous alloy compositions. This effort initially focused on the influence of silicon concentration on the physical properties of an iron-silicon alloy (hereinafter "Fe—Si alloy"). In particular, specimens of Fe—Si alloys, made of pure Fe (99.98% weight Fe, the rest being impurities) and a pure Si (99.998 wt. %-Si, the rest being impurities) were exposed to intensive hydrogen charging conditions and tested. Hydrogen charging was performed by an electrolytic method using a platinum anode in a 1N solution of $H_2SO_4$ plus 0.5% $As_2O_3$ at a duration of one hour and at a current density of 500 $A/m^2$. This corresponds to hydrogen charging of gaseous hydrogen under pressure of 100 MPa.

Applicants concluded that the hydrogen was working as an efficient alloying element. This conclusion, i.e. that hydrogen can work as an alloying element, finds support in "Interaction Hydrogen with Metals" (ed. By A. P. Zakharov), Ch.9 by Goltsov V. A., Moscow, Nauka 1987.

Figure 1:
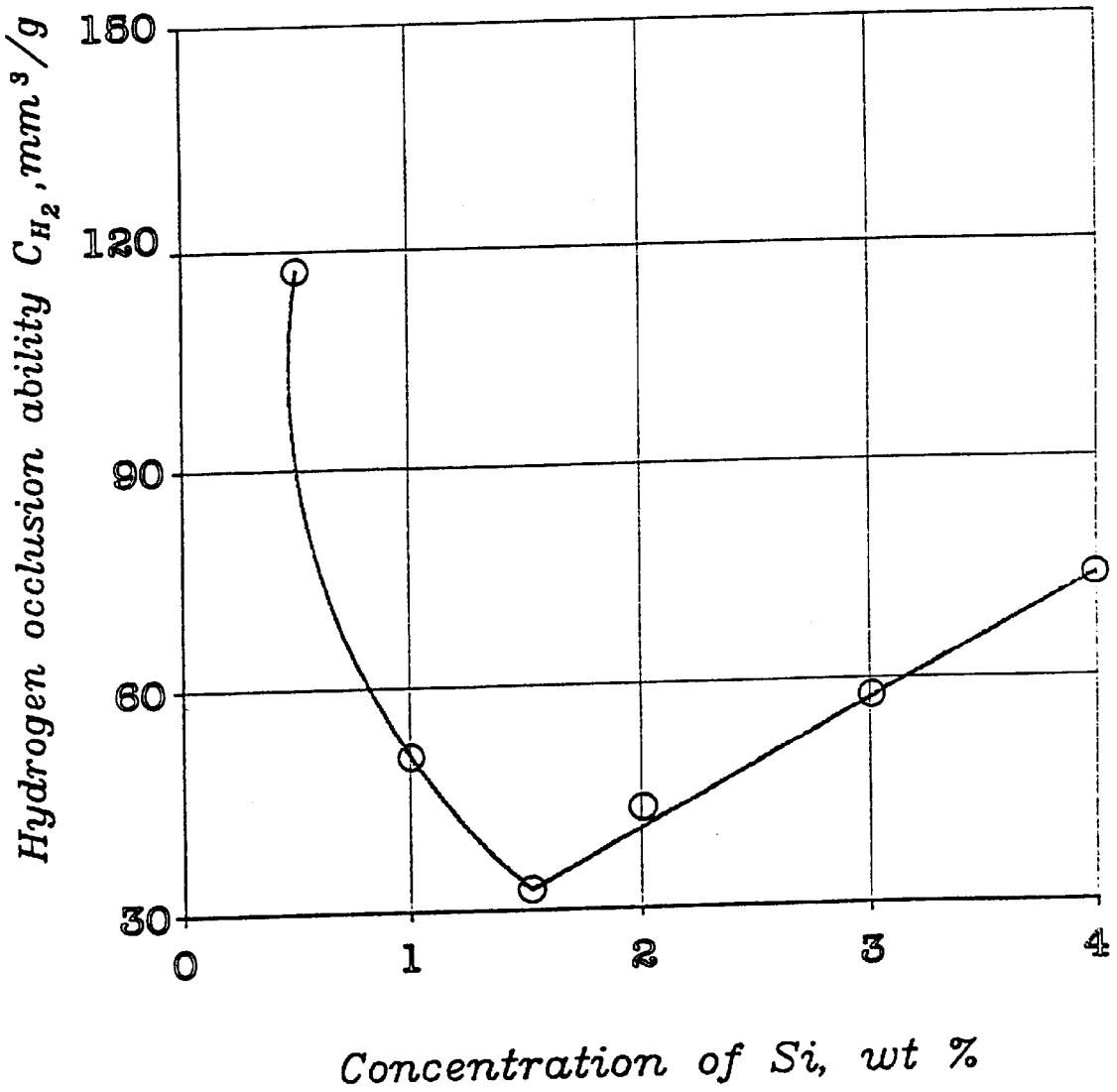

Further, applicants examined the hydrogen occlusion ability of the alloy at various concentrations of Si in the alloy. Notwithstanding that the alloys were homogeneous in phase, permanently solid solutions, based on alpha-body centered cubic Fe, applicants discovered a distinct deviation in the hydrogen occlusion ability of the Fe—Si alloys within a certain range of Si concentration. As shown in the chart of FIG. 1, noticeable changes in the range of hydrogen occlusion were observed within silicon concentrations of about 1.4% to about 1.6% weight. percent. Further, the minimum hydrogen occlusion ability of the target alloy, when the alloy absorbs a minimum amount of hydrogen, corresponds to a silicon concentration of about 1.5% weight. Since hydrogen occlusion ability of Fe and its alloys is nearly directly proportional to the degree of hydrogen embrittlement, it was concluded that the highest resistance of the Fe—Si—H system to hydrogen embrittlement may be achieved at silicon concentrations of about 1.4–1.6% weight percent.

Applicants then set out to analyze the interaction between silicon concentration and the hydrogen occlusion ability of the Fe—Si alloy and to determine the factors relevant or critical to effecting this deviation in hydrogen occlusion ability. Applicants referred to research conducted on W—Re alloys and found that the presence of 4–6 at. percent of Rhenium concentration in such alloys produces a number of unique physical characteristics in the alloy. Applicants also found that a configurational localization model comprehensibly described these effects, in particular, by a model of electronic localization of a condensed state of matter, developed by G. V. Samsonov and others. This model and the results are documented by G. V. Samsonov et al. in "Electron Localization in Solids," p. 339 (1976); "Configurational Electron Localization in Solids," Kiev, Naukova Dumka, p. 252 (1975); and in "Configurational Model of Substance," Kiev, Naukova Dumka, p. 230 (1971). These references are hereby incorporated by reference. Samsonov's model provides a correlation between the deviation in the physical properties of the alloy and a type of electron restructuring. Applicants assumed that the nature of the inventive effect is similar to a Rhenium effect. Based on such assumption, the applicants decided that the inventive effect could be described by the said theory.

This correlation is made, in particular, to an electron restructuring wherein the statistic weight of the most stable configurations increases, but the atomic or bonding stability of these configurations is not sufficient for formation of a chemical bond within a system. As a result, compounds form between the system components and, thus, the atoms of the system are "forced" to decrease its free energy virtually. An important assumption in Samsonov's model is that free, filled and half-filled configurations of the atoms are the most energetically stable (atomic stability) and that a half-filled electron configuration is the most efficient for a creation of an atomic bond (bonding stability). Accordingly, in systems with various types of atoms, a restructuring of electron configuration of the atoms takes place, wherein each atom type tends to create a filled or half-filled quasi-stable corresponding configuration. In this process, atoms of one type serve as donors, while atoms of another type serve as acceptors. The direction of the donor-acceptor interaction depends on atom characteristics such as configuration completeness, ionization potential and/or electron affinity.

Applicants analyzed the Fe and Si atoms in the inventive Fe—Si—H system, and determined that the iron acts as an electron donor while the silicon acts as an electron acceptor. During the relevant electron restructuring, iron gives off an electron to restructure its electron configuration of $3d^6$ to a quasi-stable $3d^5$ configuration ("half-filled"). Conversely, silicon's configuration of $3s^23p^2$ builds into a quasi-stable configuration of $3s^23p^6$ ("filled"). As a result, the whole Fe—Si—H system becomes quasi-stable. Applicants further note that the electron restructuring associated with Fe creates, in a $d^5$ half-filled configuration, inter-atom bonds of d-transitional metals that are at a maximum. The Fe—Si—H system according to the invention is, therefore referred to as a quasi-stable system preferably having silicon concentrations from about 1.3% to about 1.7% weight and, more preferably, from about 1.4% to about 1.6% weight.

According to the invention, introducing certain additional alloying elements into the quasi-stable Fe—Si—H system may produce an alloy having certain desirable physical properties (e.g., high yield point, hardness, etc.). In this regard, it is noted that the quasi-stability of the system depends on the stability of the created electron configuration and that the introduction of other elements (atoms) into the quasi-stable system may change a donor-acceptor interaction of the Fe—Si—H system, thereby affecting its quasi-stability. Accordingly, in one aspect of the invention, additional alloying elements are selected on the basis that such introduction of alloying elements does not affect the donor-acceptor interaction of the system and, thus, will not negatively affect the resulting alloy's resistance to hydrogen embrittlement and sulfide cracking resistance.

Carbon is one of the most important steel alloying elements. Typically, an increase in the amount of Carbon in an alloy will improve the strength of the alloy. Thus, it is particularly significant that carbon does not substantially influence the character of the Fe and Si interaction in the inventive alloy. In triple systems such as Fe—Si—C, the Fe—Si interaction is controlling.

In order to provide certain mechanical properties of the new alloy, which depend on carbon, 1020 carbon steel (C-0.21%, Mn-0.10%, S-0.04%, P-0.038%, Fe-the rest) was used initially as a basis. The 1020 steel was alloyed with silicon in the following Si concentrations: 0.47, 1.0, 1.45, 1.6, 2.0, 3.0 and 4.0% weight. percent. The hydrogen occlusion ability of the steel specimens was determined as well as conventional threshold stresses (see Table 1 and FIG. 2). The conventional threshold stresses ($\sigma_{th}$)) is the ratio between the threshold stress of the sulfide stress cracking (i.e., the maximum stress, which was applied to the specimen without failure) and yield point. The specimens were tested for 720 hours in a standard medium NACE MR0175-84. Table 2 provides a comparison of the hydrogen occlusion ability of 1020 steel and the inventive alloy.

TABLE 1

Properties of Hydrogen Charged Low Carbon Silicon Steels

| Silicon content weight, % | Hydrogen occlusion ability, $CH_2$,mm$^3$/g | Threshold stress ($\sigma_{th}$) at hydrogen sulfide cracking |
|---|---|---|
| 0.5 | 142 | 0.66 |
| 1.0 | 62 | 0.75 |
| 1.45 | 43 | 0.88 |
| 1.6 | 41 | 0.90 |
| 2.0 | 51 | 0.79 |
| 3.0 | 65 | 0.57 |
| 4.0 | 82 | — |

TABLE 2

Hydrogen Occlusion Ability

| Current desnity A/m$^2$ | Quantity of occluded hydrogen (diffusion-movable), mm$^3$/g: Steel 1020 | Quantity of occluded hydrogen (diffusion-movable), mm$^3$/g: Inventive Low Carbon Steel Alloy |
|---|---|---|
| 100 | 31 | 0 |
| 500 | 60 | 1 |
| 1000 | 149 | 4 |

Figure 2:
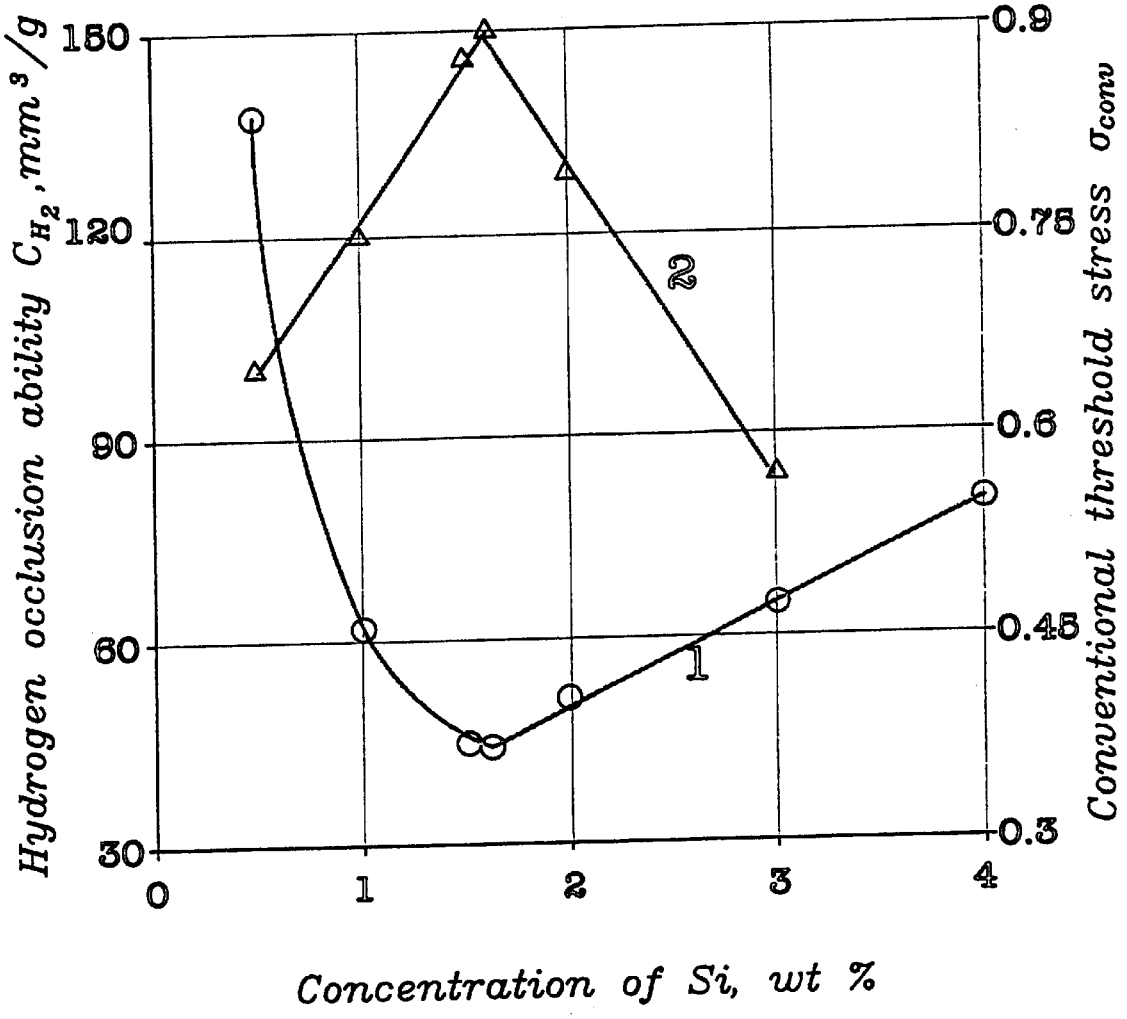

As illustrated in FIG. 2, the Si concentration curve for the 1020 carbon steel, according to the invention has an extreme character that is similar to that found for the Fe—Si alloy (as described above). In particular, the hydrogen occlusion ability of the low carbon steel is at a minimum, while conventional threshold stresses are at a maximum within the same range of silicon concentration. Based on these test results, applicants determined that carbon alloying in the amount of up to about 0.25% weight (e.g., about 0.20% weight) practically does not affect the quasi-stability of the Fe—Si—H system. Therefore, the resulting low carbon steel product, according to the invention, exhibits a high resistance to hydrogen embrittlement and to sulfide stress cracking.

In order to select a potential alloying element in the Fe—Si—H system, the introduction of which can provide a desirable property(s) in the resulting alloy composition, it is necessary to analyze the electron configuration of the atom of the potential alloying element and, then, to determine whether introduction of the element into the system precludes creation of Si's $s^2p^6$ configuration and/or Fe's $d^5$ configuration. An additional alloying element may be included in the alloy system of the invention (i.e., to attain certain desirable physical properties in the alloy) if it does not interfere with the desired Fe—Si interaction. More specifically, an alloying element may be included if it does not prevent the following interactions: $Fe \rightarrow Fe^{+}+e^{-}$ (i.e. creation of half-filled, quasi-stable $3d^5$ configuration) and $Si+4e^{-} \rightarrow Si^{4-}$ (i.e., creation of a filled, quasi-stable $3s^23p^6$ configuration).

A potential alloying element will not interfere with the desired Fe—Si interaction, if the alloying element neither works as a donor nor as an acceptor in the Fe—Si system. Such elements are further described below and may be referred to hereinafter for descriptive purposes only and with respect to the inventive Fe—Si—H system only as "Fe—Si noninteractive" elements. In at least a few cases of potential alloying elements, the element is quasi-stable due to an outermost electron configuration characterized by a free, filled, or half-filled configuration. Accordingly, these elements do not act as a donor nor as an acceptor, and are, hereinafter, referred to as "quasi-stable" elements for purposes of description of the inventive Fe—Si—H system. In other cases, a potential alloying element works as a donor in the system, (and thus, may not be included as an alloying element) if the corresponding positive ion of the donor element has an ionization energy that is lower than the ionization energy of $Fe^{+}$. Further, a potential alloying element works as an acceptor in the system, (and thus, may not be included as an alloying element) if the resulting or corresponding negative ion of the acceptor element has an ionization energy that is lower than the ionization energy of $Si^{4-}$. In summary, "Fe—Si noninteractive" elements and elements which do not act as a donor or an acceptor in the Fe—Si—H system are Fe—Si "noninteractive" elements and may be used in the inventive Fe—Si alloy.

Provided below is an example of an election reconstructing analysis associated with an alloying element selection method according to the invention. It should first be noted that the convention used herein does not correspond to the conventional chemical definition of valence. Such conventional chemical definition is not appropriate, however, in a model of electron localization of a condensed state of matter since the subject elements are in a form of solid solutions.

Example of Electron Reconstructing Analysis

Cr, Co and Ti are selected for examination as potential alloying elements at concentrations of more than 0.1% weight. The electron atom configurations for each of these elements are:

$Cr=3s^23p^23d^5$ $Co=3s^2p^63d^7$ $Ti=3s^2p^63d^2$

According to the discussion provided above, there is a tendency for the creation of free, half-filled or filled structures at the 3d level since these configurations are the most energetically stable. For the 3d level, these structures correspond to the $3d^0$, $3d^5$ and $3d^{10}$ configurations.

1. Cr may be added to the Fe—Si—H system to improve, among other things, the hardenability of the inventive alloy. Since Cr has a half-filled $3d^5$ electron configuration, it does not participate in the donor-acceptor interaction of the Fe—Si—H system (i.e., it is a Fe—Si noninteractive, quasi-stable element as discussed above). Thus, it may be used as an alloying element in the Fe—Si—H system at concentrations above 0.10% weight as well as at concentrations equal to or lower than 0.10% weight.

2. Co has an outermost electron configuration of $3d^7$. Co $3d^7$ can accept three electrons to create a filled $3d^{10}$ configuration. Thus, the energy level of the corresponding negative ion, $Co^{3-}$, is compared with the energy level of $Si^{4-}$ (i.e., $3p^2 \rightarrow 3p^6$). Since the energy level at the 3p level is considerably lower than that at the 3d level, $Co^{3-}$ cannot work as an acceptor in the Fe—Si—H system.

Co $3d^7$ can give off two electrons to create a half-filled $3d^5$ configuration. Thus, the ionization energy of the corresponding negative ion, $Co^{2+}$ is compared with that of $Fe^{+}$. Since the ionization energy of $Co^{2+}$ is significantly greater than that of $Fe^{+}$, $Co^{2+}$ does not work as a donor in the Fe—Si—H system.

Accordingly, Co may be included as an alloying element in the Fe—Si alloy of the invention, without interfering with the desired Fe—Si interaction (a Fe—Si noninteractive element).

3. Ti may be added to provide fine-grain structure, improve the hardness, hardenability and/or tensile strength of steel. Ti has an outer electron configuration of $3d^2$.

Ti $3d^2$ can accept three electrons to create the half-filled $3d^5$ configuration. Thus, the energy level of the corresponding negative ion, $Ti^{3-}$ is compared with that of $Si^{4-}$ (i.e., $3p^2 \rightarrow 3p^6$). Since the energy level at the 3p level is considerably lower than that at the 3d level, Ti does not work as an acceptor in the Fe—Si—H system.

Ti $3d^2$ can give off two electrons to create a free $3d^0$ electron configuration. Thus, the ionization energy of the corresponding positive ion, $Ti^{2+}$, is compared with that of $Fe^+$. In this case, the ionization energy of $Ti^{2+}$ is significantly greater than that of $Fe^+$. Therefore, Ti does not work as an electron donor in the Fe—Si—H system.

Accordingly, Ti may be included as an alloying element in the Fe—Si alloy of the invention, without interfering with the desired Fe—Si interaction (a Fe—Si noninteractive element).

In another aspect of the invention, the applicants have determined that the majority of alloying elements with a concentration of less than or equal to 0.10% weight practically does not affect the quasi-stability of the inventive Fe—Si—H system (i.e., Fe—Si noninteractive), provided that such concentrations of these elements, create a continuous array of solid solutions with iron. In other words, when introduced at these concentrations, the majority of potential alloying elements will not interfere with the desired Fe—Si interaction and thus, may be included as an alloying element to obtain an alloy characterized by an improved resistance to hydrogen embrittlement and to sulfide stress cracking, as well as other desirable mechanical properties. Alloying elements which may be included at concentration of less than 0.10% weight, but are not necessarily limited to, the elements listed in Table 3.

TABLE 3

Alloying Elements for Fe—Si—H System, in Concentrations less than or Equal to about 0.10% Wt.

| Element | Element |
|---|---|
| Be, Beryllium | Ag, Silver |
| Mg, Magnesium | Cd, Cadmium |
| Al, Aluminum | La, Lanthanum |
| Ca, Calcium | Ce, Cerium |
| Sc, Scandium | Pr, Promethium |
| Ti, Titanium | Nd, Neodymium |
| V, Vanadium | Gd, Gadolinium |
| Cr, Chromium | Tb, Terbium |
| Mn, Manganese | Dy, Dysprosium |
| Co, Cobalt | Er, Erbium |
| Ni, Nickel | W, Tungsten |
| Cu, Copper | Re, Rhenium |
| Zn, Zinc | Os, Osmium |
| Ge, Germanium | Pb, Lead |
| Se, Selenium | Bi, Bismuth |
| Rb, Rubidium | U, Uranium |
| Zr, Zirconium | Mo, Molybdenum |
| Nb, Niobium | |
| Ru, Ruthenium | |

It should be noted that several of the elements listed above may be introduced at concentrations above 0.10% weight as well.

Provided below are examples of alloy formulations according to the invention. These examples, or embodiments of the invention, are provided for exemplary purposes and shall not serve to limit the invention. Further, the concentration of various elements indicated therein are estimates and/or preferred amounts; variations in the formulations involving different concentrations for the give elements will be apparent to one skilled in the art, upon reading the Description and viewing the Drawings provided herein.

EXAMPLE OF A FIRST EMBODIMENT

Following the synthesis described above, a first embodiment of the inventive alloy has been formulated which is particularly suited for a variety of applications including steel plates and tubular products. The inventive alloy has the following composition:

TABLE 4

Composition of an Invention Fe—Si Alloy

| Element | Percent Wt. |
|---|---|
| Carbon, C | 0.21 |
| Silicon, Si | 1.42 |
| Vanadium, V | 0.085 |
| Aluminum, Al | 0.094 |
| Rare earth metals, rem | 0.09 |
| Manganese, Mn | 0.07 |
| Nitrogen, N | 0.026 |
| Sulphur, S | 0.016 |
| Phosphorous, P | 0.023 |
| Iron, Fe + inevitable impurities | Substantially the remainder |

Note that none of the alloy elements, other than Fe, C and Si, are included in concentrations greater than 0.10% wt. To evaluate the criteria used for selection of the alloying elements of the above-described alloy, specimens of the alloy were taken and tested to determine specifically the stability of the Fe—Si—H System. The alloy product was melted and rolled in industrial manufacturing conditions. In order to choose an optimum regime of heat treatment, a dilatometric analysis of the alloy was performed, which showed that the "α-γ" transformation occurs rather slowly and without a distinct point of transformation within the temperature range of 923–943° C. Then, the specimens were quenched at temperatures of 1000, 1050 and 1150° C., followed by tempering at 500 and 600 respectively. A metallographic analysis shows that the resulting alloy has an inherited fine grain structure and a hardness of about 21 to 22.3 RC.

Table 5 provides mechanical properties of the inventive alloy at five different regimes of heat treatment.

TABLE 5

Mechanical Properties of Inventive Fe—Si Alloy

| Regime of heat treatment | | The mechanical properties | | | |
|---|---|---|---|---|---|
| Quenching, ° C. | Tempering, ° C. | Tensile strength, MPa | Yield point, MPa | Reduction of area, % | Elongation, % |
| 1000 | 500 | 833 | 728 | 41.9 | 12.0 |
| 1000 | 600 | 755 | 600 | 44.4 | 14.1 |
| 1050 | 500 | 846 | 742 | 40.0 | 12.3 |
| 1050 | 600 | 750 | 593 | 43.0 | 14.5 |
| 1150 | 600 | 786 | 660 | 41.5 | 11.0 |

The specimens (heat-treated in the 5 regimes) were also tested for sulfide stress cracking, according to the standard NACE MR 0175-84. Each of the specimens passed the base test and did not fail. Further, the specimens were tested in the same medium for general corrosion, and performed sufficiently well to be deemed a corrosion resistant alloy.

Next, specimens of carbon steel 1020 and the inventive alloy product were tested with the purpose of comparing the properties of the two steels. In particular, cylinder specimens with 1 mm walls were tested for hydrogen permeability. Hydrogen charging was performed using an electrolytic method in 1N solution of $H_2SO_4$ plus 0.5% $AS_2O_3$ at a duration of one hour. The results (see Table 7) illustrate that at the current density of more than 1,000 $A/m^2$ specimens of steel 1020 occluded hydrogen to a degree where it practically failed. On the other hand, the inventive alloy was found to have a permeability to hydrogen that was ten times less than that for steel 1020.

Further, disk-shaped specimens in diameters of 20 mm and a thickness of 1.25 mm were hydrogen charged in the same regime and their surfaces were examined. These particular cylinders were chosen because metal deterioration due to hydrogen cracking typically starts from the surface. It was found that there was some hydrogen blistering on the surface of the steel 1020 disc occurring at the current density of 350 $A/m^2$. At the current density of 500 $A/m^2$, it was found that considerably more blisters were evident, and at 1000 $A/m^2$, almost the entire surface of the 1020 steel discs was covered with large hydrogen blisters. Thus, the 1020 steel was deemed to have practically failed. On the other hand, the surface of the inventive alloy disks did not show any trace of hydrogen blisters, even at the current density of 1700 $A/m^2$. Accordingly, it was shown that the inventive alloy is hydrogen resistant even in the conditions of extremely intensive hydrogen charging.

Hydrogen concentration on the subsurface layers (at depths of approximately 0.01 mm) of steel 1020 and the inventive alloy specimens was also measured using a means of a secondary ion-ion emission, before and after the specimens were held for a duration of 300 hours in 3% aqueous solution of NaCl plus 0.5% acidic acid saturated with $H_2S$. The results are tabulated in Table 6 and illustrate that the inventive alloy's occlusion of hydrogen is about 65 times less than that of steel 1020.

TABLE 6

Hydrogen Concentration in Surface Layer

| | Conventional units | | |
|---|---|---|---|
| Material | Produced material, H p. | Hydrogen charged material, H c. | ΔH = H c. − H p. |
| Steel 1020 | 9.0 | 57.1 | 46.1 |
| Inventive Alloy | 15.2 | 15.9 | 0.7 |

Also very illustrative, is the information in Table 7, which shows a comparison of the measurements of hydrogen permeability of the 1020 steel and inventive alloy specimens. The results show that at the current density of less than 1000 $A/m^2$, hydrogen permeability of inventive alloy was 10 times less than that of steel 1020.

TABLE 7

Hydrogen Permeability at Electrolytic Hydrogen Charging

| Current density, | Hydrogen permeability, ml $m^2/s$ | |
|---|---|---|
| $A/m^2$ | Steel 1020 | HHR1 |
| 500 . . . 1000 | 66.9 . . . 99.4 | 5.1 . . . 7.6 |
| 1000 . . . 1700 | Specimens failed | 7.6 . . . 10.7 |

SECOND AND THIRD EMBODIMENTS

Applicants have also developed, using the same principals used in formulating the above-described embodiment, two alternative Fe—Si alloys. The compositions of these alloys are described below.

TABLE 8

Composition of Second Embodiment of an Inventive Fe—Si Alloy

| Element | % Wt. |
|---|---|
| Carbon, C | 0.18 |
| Silicon, Si | 1.43 |
| Chromium, Cr | 0.16 |
| Nickel, Ni | 0.17 |
| Vanadium, V | 0.90 |
| Aluminum, Al | 0.15 |
| Rare earth metals, rem | 0.10 |
| Manganese, Mn | 0.67 |
| Nitrogen, N | 0.015 |
| Sulphur, S | 0.021 |
| Phosphorus, P | 0.024 |
| Iron, Fe + inevitable impurities | Substantially the remainder |

The second embodiment according to the above composition may be utilized after a heat treatment consisting of quenching and high tempering. The resulting alloy product is particularly suited for production tubing, casing and the like. Preferably, the alloy is quenched from 1000° C. and 1050° C., followed by tempering at 500° C. and 600° C., respectively; and quenching from 1150° C. followed by tempering at 600° C. After heat treatment, specimens of this second embodiment of the inventive alloy were tested for sulfide stress cracking in accordance with the above-described method. All specimens of this second embodiment passed the base testing without any failures.

The specimens were also found to have an ultimate tensile strength in the range of 862–940 MPa, a yield point of 720–825 MPa, and a hardness of 21–24.5 RC. Further, the inventive alloy was found to have an elongation of 9.3 to 13.5% and a reduction of area of 38.1 to 43.4%.

A third embodiment of the inventive alloy has the following chemical composition:

TABLE 9

Composition of Third Embodiment of an Inventive Fe—Si Alloy

| Element | % Wt. |
|---|---|
| Carbon, C | 0.23 |
| Silicon, Si | 1.55 |
| Chromium, Cr | 0.12 |
| Vanadium, V | 0.11 |
| Aluminum, Al | 0.14 |
| Rare earth metals, REM | 0.08 |
| Manganese, Mn | 0.12 |
| Nickel, Ni | 0.18 |
| Nitrogen, N | 0.015 |
| Titanium, Ti | 0.012 |
| Copper, Cu | 0.08 |
| Sulphur, S | 0.010 |
| Phosphorous, P | 0.009 |
| Iron, Fe + inevitable impurities | Substantially the remainder |

The third embodiment, according to the composition provided above is particularly adapted for rolled sheets after a normalizing heat treatment. Specimens of the third embodiment of the inventive alloy were taken and tested in accordance with the above-described methods of testing for sulfide stress cracking.

Again, all specimens of the third embodiment passed the base testing without any failure. After heat treatment (normalization) to 880° C., the mechanical properties of the alloy product were determined. The alloy product was found to have a tensile strength of 620 MPa, a yield point of 415 MPa, and a hardness of 16 RC. The specimens of the alloy product were also found to have an elongation of about 24% and a reduction of area of about 46%

The quasi-stability of the Fe—Si—H System, according to the present invention, having a silicon concentration of preferably from about 1.3% to 1.7% weight (and, more preferably, about 1.4% to 1.6% weight) and with a certain set of the alloying elements selected according to the above-mentioned criteria and under the conditions of an intensive hydrogen charging, provides a possibility to develop new alloy materials (i.e., steels), which are highly resistant to hydrogen embrittlement and which have the necessary or desirable corresponding working physical characteristics.

The foregoing description has been presented for purposes of illustration and is not intended to limit the invention to the forms disclosed herein. Consequently, variations and modifications commensurate with the above teachings, and the skill or knowledge of the relevant art, are within the scope of the invention. The embodiments described herein are further intended to explain the best mode known for practicing the invention and to enable others skilled in the art to utilize the invention in such, or other, embodiments and with various modifications required by the particular applications or uses of the present invention. It is intended that the dependent claims be construed to include alternative embodiments to the extent that is permitted by prior art.

What is claimed is:

1. An alloy, based on an iron-silicon alloy, exhibiting improved resistance to hydrogen embrittlement and sulfide stress cracking in a hydrogen-charging medium, said alloy comprising:

about 1.3% to 1.7% weight of Si;

at least one alloying element selected from the group consisting of: Be, Mg, Al, Ca, Sc, Ti, V, Cr, Mn, Co, Ni, Cu, Zn, W, Mo, Ge, Se, Rb, Zr, Nb, Ru, Ag, Cd, La, Ce, Pr, Nd, Gd, Tb, Dy, Er, Re, Os, Pb, Bi, U, N and other REM and wherein said at least one alloying element is individually present in a concentration up to about 0.10% weight; and substantially the rest comprising Fe and inevitable impurities;

wherein Fe is a donor element with respect to Si and Si is an acceptor element with respect to Fe.

2. The alloy of claim 1, wherein the concentration of Si is about 1.4% to 1.6% weight.

3. The alloy of claim 1, wherein said alloy is adapted to form a quasi-stable Fe—Si—H system upon substantial exposure to the hydrogen-charging environment and wherein said at least one alloying element has an atom structure configured such that the presence of said alloying element in said system does not interfere with an electron structure of said system.

4. The alloy of claim 1, wherein said alloy is adapted to form a quasi-stable Fe—Si—H system upon substantial exposure to the hydrogen-charging environment and wherein said at least one alloying element has an atom structure configured such that said alloying element is not a donor or an acceptor element with respect to Fe or Si in said system.

5. The alloy of claim 1, wherein said alloy is adapted to form a quasi-stable Fe—Si—H system upon substantial exposure to the hydrogen-charging environment and wherein said at least one alloying element is an Fe—Si noninteractive element with respect to Fe and Si.

6. The alloy of claim 1, further comprising about 0.10% to 0.25% weight of C.

7. The alloy of claim 1, wherein the concentration of C is about 0.18% to 0.23% weight.

8. The alloy of claim 1, wherein said at least alloying element is selected from the group consisting of: Be, Mg, Al, Ca, Ti, V, Cr, Mn, Co, Ni, Cu, Zn, W, Mo and REM.

9. The alloy of claim 8, further comprising:

about 0.07% to 0.12% weight of V;

about 0.08% to 0.016% weight of Al;

about 0.08% to 0.11% weight of rare earth metals;

about 0.06% to 0.09% weight of Mn;

up to about 0.035% weight of S;

up to about 0.035% weight of P;

about 0.01% to 0.03% weight of N; and about 0.05% to 0.26% weight of C.

10. An iron-silicon alloy exhibiting improved resistance to hydrogen embrittlement and sulfide stress cracking in a hydrogen-charging medium, said alloy consisting essentially of:

about 1.3% to 1.7% weight of Si; and substantially the rest comprising Fe and inevitable impurities; and wherein said alloy is characterized by a quasi stable Fe—Si—H system upon substantial exposure to the hydrogen-charging medium, in which said Fe is a donor element with respect to Si and Si is an acceptor element with respect to Fe.

11. The alloy of claim 10, further comprising at least one alloying element having an atom structure configured such that said alloying element is not a donor or an acceptor element with respect to Fe or Si in said system.

12. The alloy of claim 11, wherein said at least one alloying element has an atom structure configured such that the presence of said alloying element in said system does not interfere with an electron structure of said Fe—Si—H system wherein Fe is said donor element and Si is said acceptor element.

13. The alloy of claim 11, wherein said at least one alloying element is a Fe—Si noninteractive element with respect to Fe and Si.

14. The alloy of claim 11 wherein said at least one alloying element is individually present in a concentration up to about 0.10% weight and selected from the group consisting of: Be, Mg, Al, Ca, Ti, V, Cr, Mn, Co, Ni, Cu, Zn, W, Mo and REM.

15. The alloy of claim 10, wherein the concentration of Si is about 1.4% to 1.6% weight.

16. The alloy of claim 10, further comprising about 0.10% to 0.26% weight of C.

17. The alloy of claim 10, wherein the concentration of C is about 0.18% to 0.23% weight.

18. The alloy of claim 10, further comprising:

about 0.07% to 1.20% weight of V;

about 0.08% to 0.016% weight of Al;

about 0.08% to 0.11% weight of rare earth metals;

about 0.60% to 0.90% weight of Mn;

up to about 0.035% weight of S;

up to about 0.035% weight of P; and about 0.01% to 0.03% weight of N.

19. The alloy of claim 10, further comprising:

about 0.10% to 0.18% weight of Cr; and about 0.015% to 0.020% weight of Ni.

20. An alloy, based on an iron-silicon alloy, exhibiting improved resistance to hydrogen embrittlement and sulfide stress cracking in a hydrogen-charged medium wherein H acts as a catalyst in a quasi-stable Fe—Si—H system, said alloy comprising:

about 1.3% to 1.7% weight of Si;

up to about 0.25% weight of C;

about 0.07 to 1.2% weight of V;

about 0.09 to 0.16% weight of Al;

about 0.07 to 0.11% weight of REM;

about 0.06% to 0.90% weight of Mn;

up to about 0.035% weight of S;

up to about 0.035% weight of P;

about 0.01% to about 0.03% weight of N; and substantially the rest being Fe and inevitable impurities.

21. The alloy of claim 20, wherein the concentration of Si is about 1.4% to 1.6% weight.

22. The alloy of claim 21, wherein the concentration of C is about 0.16% to 0.23% weight.

23. The alloy of claim 22, wherein said alloy is adapted such that Fe is a donor element with respect to Si and Si is an acceptor element with respect to Fe.

24. A structural steel product characterized by improved resistance to hydrogen embrittlement and sulfide stress cracking in an intensive hydrogen-charging environment, formed substantially from an alloy consisting essentially of:

about 1.3% to 1.7% weight of Si;

up to about 0.25% weight of C;

at least one alloying element individually present and selected from the group consisting of Be, Mg, Al, Ca, Sc, Ti, V, Cr, Mn, Co, Ni, Cu, W, Mo, Zn, Ge, Se, Rb, Zr, Nb, Ru, Ag, Cd, La, Cc, Pr, Nd, Gd, Tb, Dy, Er, Re, Os, Pb, Bi, U, N and other REM; and substantially the rest being Fe and inevitable impurities; and wherein H from said hydrogen-charging environment acts as a catalyst in a quasi-stable Fe—Si—H system.

25. The steel product of claim 24, wherein said alloy has about 1.38% to about 1.63% weight of Si.

26. The steel product of claim 24, wherein said alloy has about 0.16% to about 0.24% weight of C.

27. The steel product of claim 24, wherein said alloy has about 0.07% to about 0.12% weight of V, about 0.09 to 0.16% weight of Al, about 0.07 to 0.11% weight of REM, about 0.06% to 0.13% weight of Mn, up to about 0.035% weight of P, up to about 0.035% weight of S, about 0.01% to 0.03% weight of N, and up to about 0.19% weight of Ni.

28. The steel product of claim 24, wherein said at least one alloying element is selected from the group consisting of: Be, Mg, Al, Ca, Ti, V, Cr, Mn, Co, Ni, Cu, Zn, W, Mo and REM.

29. The steel product of claim 24, wherein said alloy is a heat treated alloy.

30. An alloy, based on an iron-silicon alloy exhibiting improved resistance to hydrogen embrittlement and sulfide stress cracking in a hydrogen-charging environment, said alloy being substantially exposed to the hydrogen charging environment, said alloy consisting essentially of:

about 1.3% to 1.7% weight of Si, wherein said Si interacts with Fe and H to form a quasi-stable Fe—Si—H system in which said Si is an acceptor element with respect to Fe, Fe is a donor element with respect to Si, and H is a catalyst;

about 0.10% to 0.25% weight of C;

at least one Fe—Si noninteractive alloying element, said Fe—Si noninteractive alloying element being characterized by an atom structure configured such that said alloying element is not a donor element or an acceptor element with respect to Fe or Si in said Fe—Si—H system; and substantially the rest comprising Fe and inevitable impurities.

31. The alloy of claim 30, wherein said at least one Fe—Si noninteractive alloying element has an atom structure configured such that the presence of said alloying element in said Fe—Si—H alloy system does not interfere with an electron structure of said Fe—Si—H wherein Fe is said donor element and Si is said acceptor element.

32. The alloy of claim 30, wherein said at least one Fe—Si noninteractive alloying element is present in a concentration up to about 0.10% weight and is selected from the group consisting of: Be, Mg, Al, Ca, Sc, Ti, V, Cr, Mn, Co, Ni, Cu, Zn, W, Mo and REM.

33. The alloy of claim 30, wherein the concentration of Si is about 1.4% to 1.6% weight.

34. The alloy of claim 30, wherein the concentration of C is about 0.18% to 0.23% weight.

35. The alloy of claim 1, wherein said alloy is adapted to form a quasi-stablc Fe—Si—H system upon substantial exposure to the hydrogen-charging medium.

36. The alloy of claim 1, further comprising about 0.05% to 0.26% by weight of C.

37. A method of formulating the constituents of an alloy, based on an iron-silicon alloy, that exhibits improved resistance to hydrogen embrittlement and sulfide stress cracking in a hydrogen-charging medium, said method comprising the steps of:

selecting Si in a concentration of between about 1.3% and 1.7% by weight;

selecting at least one alloying element having an atom structure configured such that the alloy is adapted to form a quasi-stable Fe—Si—H system in the hydrogen-charging medium, whereby Fe is a donor element with respect to Si and Si is an acceptor element with respect to Fe and the alloying element is noninteractive with respect to Fe and Si; and providing Fe and inevitable impurities as the remaining constituents of the alloy.

38. A method of formulating the constituents of an alloy, based on an iron-silicon alloy, that exhibits improved resistance to hydrogen embrittlement and sulfide stress cracking in a hydrogen-charging environment, said method comprising the steps of:

selecting Si in a concentration between about 1.4% to 1.6% by weight;

selecting C in a concentration of up to about 0.26% by weight;

selecting one or more alloying elements from the group consisting of: Be, Mg, Al, Cu, Sc, Ti, V, Cr, Mn, Co, Ni, Zn, W, Mo and REM, each of the alloying elements being selected such that the alloy is adapted to form a quasi-stable Fe—Si—H system in the hydrogen-charging medium, wherein Fe is a donor element with respect to Si and Si is an acceptor element with respect to Fe, and each of the alloying elements is Fe—S noninteractive with respect to Fe or Si in the system; and providing for Fe and inevitable impurities as the remaining constituents of the alloy.

* * * * *